US008087868B2

(12) United States Patent
Turnbull et al.

(10) Patent No.: US 8,087,868 B2
(45) Date of Patent: Jan. 3, 2012

(54) FORKLIFT TRUCK FOR MOUNTING ON THE REAR OF A CARRYING VEHICLE WITH A FORK SIDE SHIFTING ATTACHMENT

(75) Inventors: Kevin Turnbull, Dundalk (IE); Barry McGrane, Clogherhead (IE)

(73) Assignee: Moffett Research and Development Limited, Dundalk (IE)

( * ) Notice: Subject to any disclaimer, the term of this patent is extended or adjusted under 35 U.S.C. 154(b) by 814 days.

(21) Appl. No.: 10/585,743

(22) PCT Filed: Jan. 13, 2004

(86) PCT No.: PCT/IE2004/000004

§ 371 (c)(1),
(2), (4) Date: Aug. 11, 2008

(87) PCT Pub. No.: WO2005/068345

PCT Pub. Date: Jul. 28, 2005

(65) Prior Publication Data

US 2008/0296094 A1 Dec. 4, 2008

(51) Int. Cl.
*B66F 9/12* (2006.01)

(52) U.S. Cl. ..... 414/668; 414/659; 414/664

(58) Field of Classification Search ..... 414/664, 414/665, 666, 667, 668, 669, 662, 663, 467, 414/471, 486, 629, 659; 187/222, 233, 237
See application file for complete search history.

(56) References Cited

U.S. PATENT DOCUMENTS

| | | | | | |
|---|---|---|---|---|---|
| 2,349,352 | A | * | 5/1944 | Johnson | 414/635 |
| 3,166,209 | A | | 1/1965 | Haddock, Jr. | |
| 3,184,088 | A | * | 5/1965 | Berge | 414/621 |
| 3,684,113 | A | * | 8/1972 | Roller | 414/621 |
| 3,754,673 | A | * | 8/1973 | Barda et al. | 414/667 |
| 3,822,803 | A | | 7/1974 | Thompson | |
| 3,999,674 | A | * | 12/1976 | Meitl | 414/485 |
| 4,095,714 | A | * | 6/1978 | Schuster | 414/607 |
| 4,392,773 | A | * | 7/1983 | Johannson | 414/667 |
| 4,607,997 | A | | 8/1986 | Asano | |
| 4,615,533 | A | * | 10/1986 | Sewell | 280/43.12 |
| 5,088,880 | A | * | 2/1992 | Field, Jr. | 414/667 |
| 5,096,363 | A | * | 3/1992 | Weinert et al. | 414/667 |
| 5,139,385 | A | * | 8/1992 | Chase et al. | 414/667 |

(Continued)

FOREIGN PATENT DOCUMENTS

GB 1 491 422 A 11/1977

(Continued)

*Primary Examiner* — Saul Rodriguez
*Assistant Examiner* — Glenn Myers
(74) *Attorney, Agent, or Firm* — Holland & Knight LLP; Brian J. Colandreo, Esq.; Jeffrey T. Placker, Esq.

(57) ABSTRACT

This invention relates to a forklift truck (1) of the type suitable for mounting on the rear of a carrying vehicle, the forklift truck comprising a u-shaped chassis (3) having a vertical mast (17) mounted thereon. The vertical mast carries a side shift mechanism (21), the side shift mechanism comprising a fixed carriage (23) with a movable carriage (25) slidably mounted thereon. A pair of fluid actuated rams (27, 29) is provided to slide the movable carriage (25) laterally relative to the fixed carriage (23). A rotating cylinder (49) is provided to rotate a pair of forks (19) mounted on the movable carriage. The configuration achieves greater side shift without the use of rollers or chains and permits the use of a rotating cylinder.

23 Claims, 7 Drawing Sheets

U.S. PATENT DOCUMENTS 5,277,268 A * 1/1994 Kuwayama et al. ..... 180/216
5,336,039 A * 8/1994 House ..... 414/621
5,509,774 A * 4/1996 Yoo ..... 414/622
5,813,821 A * 9/1998 Braud ..... 414/667
5,890,563 A * 4/1999 Avitan et al. ..... 187/228
6,079,935 A * 6/2000 Brunner et al. ..... 414/641
6,189,964 B1 * 2/2001 Henshaw et al. ..... 297/112
2002/0057959 A1 5/2002 Karr
2003/0156935 A1 8/2003 Mondani et al.

FOREIGN PATENT DOCUMENTS

GB 2 259 292 A 3/1993

* cited by examiner 21
23
25
27
29
31
33
35
A

FORKLIFT TRUCK FOR MOUNTING ON THE REAR OF A CARRYING VEHICLE WITH A FORK SIDE SHIFTING ATTACHMENT

This invention relates to a forklift truck for mounting on the rear of a carrying vehicle, the forklift truck comprising a unshaped chassis having a crossbar and pair of side bars mounted at the ends of the crossbar and projecting forwardly therefrom, a wheel located adjacent the front of each of the sidebars, a steerable rear wheel located centrally on the crossbar, a driver's station positioned to one side of the chassis and a motive power unit positioned on the opposite side of the chassis, the chassis mounting a lifting member carrying forks, the lifting member being connected to the forks by way of a side shift mechanism comprising a fixed carriage and a movable carriage slidably mounted on the fixed carriage and means to shift the movable carriage relative the fixed carriage from a central position to positions laterally extending therefrom on either side of the fixed carriage.

For several years, forklift trucks, and in particular forklift trucks for mounting on the rear of a carrying vehicle, have been provided with side shift mechanisms. Side shift mechanisms were introduced on forklift trucks to allow for a certain degree of driver error when manoeuvering the vehicle. When loading or unloading goods on a pallet to or from a lorry or container or the like, the driver of the forklift must accurately steer his vehicle so that the forks of his vehicle engage the corresponding channels formed in a pallet. In order to prevent repetitive attempts at alignment of the tines with the channels in the pallet by reversing and repositioning the forklift truck, a side shift mechanism is often provided on the forklift truck. This side shift mechanism allows the operator of the vehicle to shift the tines laterally perpendicular to the centre line of the truck by a limited amount until the tines are in alignment with the channels, thereby compensating for a certain degree of driver error.

Side shift mechanisms are also extremely useful when the forklift truck is required to position goods up against the side wall of a container or other area where there is limited room to maneuver. The forklift may be driven in to the container until the goods are adjacent the side wall of the container and thereafter the side shift mechanism may be operated to move the goods closer to the wall. The side shift mechanism allows the operator of the forklift to pack goods closely against the wall of the container thereby utilizing the available space in the most efficient manner.

Several different types of side shift mechanisms have been produced to overcome this problem. One such known type of side shift mechanism is that described in GB1491422 (Kooi) which describes a side shift mechanism in which the entire mast moves laterally across the forklift truck. This is a relatively simple construction of side shift mechanism and may be used to move relatively small loads. However, once the weight of the load increases this arrangement becomes less feasible as the mast and the forks must also increase in strength and weight and it becomes more and more difficult to move these heavier weights. Another disadvantage of this type of side shift mechanism is that the lateral stability of the forklift is reduced due to the weight transfer of the entire mast being shifted to one side or the other. The amount by which the tines may move from one side to the other is also quite limited in the side shift mechanism described due to the use of a single ram to shift the mast from side to side.

WO03070617 (Lift Technologies Inc) shows a side shift mechanism that has a carriage and a side shift frame and a pair of hydraulic rams connected end to end to move the side shift frame relative the carriage. Both of the hydraulic cylinders are connected to the carriage and the side shift frame. This side shift mechanism has the problem that it is relatively limited in the distance by which it may move the tines laterally from side to side and will only be able to move the tines from side to side by an amount just less than the length of the stroke of the hydraulic cylinder. This may be insufficient when loading or unloading a container when it may be necessary to shift the tines sideways by a significant distance. This arrangement would also not allow for the placement of a rotating cylinder to allow rotation to be applied to the forks when the forklift is operating on uneven ground.

Other known side shift mechanisms have a single cylinder used in conjunction with a chain and roller arrangement. The chain and rollers act, to double the stroke of the cylinder and therefore shift the movable carriage by an amount substantially double that of the stroke of the cylinder. Although this goes some way to obviating the difficulties associated with limited reach of the other known mechanisms there are numerous problems associated with implementing this type of mechanism particularly when dealing with truck mounted forklifts. First of all, truck mounted forklifts are necessarily as light weight as possible. Any additional weight of the truck mounted forklift reduces the possible carrying weight of the vehicle upon which it is being transported which is highly undesirable. The additional weight of the chains and rollers add significantly to the overall weight of the forklift thereby reducing the carrying weight of the carrying vehicle and compromises elsewhere must be made to incorporate the side shift mechanism. Another problem with having chains and rollers is that the truck mounted forklifts are often carried on the back of a carrying vehicle for significant periods of time during which the forklift will be subjected to jarring and severe vibrations particularly if travelling over rough terrain. Chains and rollers that are subjected to this treatment are prone to damage and even failure.

Furthermore, side shift mechanisms having chains and rollers have the added problem that there are more working parts forming the side shift mechanisms which inevitably are prone to corrosion and failure. This results in a less robust mechanism which will require additional maintenance work to be carried out over the lifetime of the forklift. Furthermore, by having the chains and rollers, the side shift mechanism will be more complex and will therefore be more difficult and expensive to manufacture.

It is an object therefore of the present invention to provide a side shift mechanism that overcomes at least some of the difficulties associated with the known side shift mechanisms, that has good sideways reach while remaining robust and that is both simple and cost efficient to manufacture.

STATEMENTS OF INVENTION

According to the invention there is provided a forklift truck for mounting on the rear of a carrying vehicle, the forklift truck comprising a u-shaped chassis having a crossbar and pair of side bars mounted at the ends of the crossbar and projecting forwardly therefrom, a wheel located adjacent the front of each of the sidebars, a steerable rear wheel located centrally on the crossbar, a driver's station positioned to one side of the chassis and a motive power unit positioned on the opposite side of the chassis, the chassis mounting a lifting member carrying forks, the lifting member being connected to the forks by way of a side shift mechanism comprising a fixed carriage and a movable carriage slidably mounted on the fixed carriage and means to shift the movable carriage relative the fixed carriage from a central position to positions laterally extending therefrom on either side of the fixed carriage, characterised in that:— the means to shift the movable carriage laterally relative the fixed carriage further comprises a pair of fluid actuated rams each having a cylinder, a piston and an elongate piston rod connected at one end to the piston, the cylinders of the pair of fluid actuated rams being connected together side by side, the free end of one of the piston rods being connected to the fixed carriage and the free end of the other piston rod being connected to the movable carriage.

By having such an arrangement, the forklift will have a sideways reach of almost twice the stroke of one cylinder, gaining all the advantages of the chain and roller arrangement referred to above without the disadvantages of using chains and rollers. This will enable the side shift mechanism to be used to load and unload goods from the inside of containers and the like and will enable the forklift to load and unload goods that are located close to the sidewall of the container. This is achieved without the need for chains and rollers and therefore the side shift mechanism has an extremely simple construction that will be both simple and cost efficient to manufacture while at the same time remaining robust and not prone to damage during transit on the back of a carrying vehicle. Furthermore, by eliminating the chains and rollers from the side shift mechanism the weight of the side shift mechanism can be significantly reduced thereby improving the carrying capacity of the carrying vehicle. The forklift side shift mechanism will have less moving parts prone to corrosion, wear and tear and will therefore result in savings in servicing of the mechanism over its lifetime.

In another embodiment of the invention there is provided a forklift truck in which the forks are mounted on the movable carriage, the forks being mounted for pivotal movement about a horizontal axis parallel to the horizontal longitudinal axis of the forklift truck, the forks being movable under the operation of a rotating ram. This is seen as a very important advantage of the present invention as effectively there will be provided a side shift mechanism that will allow the tines or other lifting member to be shifted sideways relative the central axis of the load vehicle as well as being tilted to one side or the other at the same time. The rotation feature is very important as this will allow the tines to be aligned with channels in a pallet to be loaded when the loading vehicle is being operated on an uneven surface. Similarly, if the loading vehicle is being operated in conditions where the ground may subside by a significant amount such as in sand or mud, the tines may be adjusted accordingly by a desired amount. This is partially made possible by the arrangement of cylinders used to shift the tines sideways relative the central axis of the vehicle.

In one embodiment of the invention there is provided a forklift truck in which the fluid actuated rams are single acting rams and there is further provided a return biasing means urging each of the single acting rams to a fully contracted configuration. By having single acting rams, the number of fluid cables that need to be provided are reduced to a minimum which will result in a less complex arrangement of side shift mechanism. Preferably though, there will be provided a side shift mechanism in which each fluid actuated ram is a double acting ram. By having double acting rams, the pressures exerted on the cylinders will be reduced as both cylinders may act to move the tines to one side or the other as opposed to one direction only. This may also result in a smoother sideways movement of the tines.

In a further embodiment of the invention there is provided a forklift truck in which the fluid actuated rams are hydraulic rams. These are seen as a cost effective type of ram to use while still remaining reliable. Alternatively, the fluid actuated rams could be pneumatic rams.

In another embodiment of the invention there is provided a forklift truck in which there is provided means to operate the fluid actuated rams independently of each other. In this way, closer control of the positioning of the tines may be achieved as smaller adjustments may be easily made to the sideways movement of the tines.

In one embodiment of the invention there is provided a forklift truck in which there is provided means to operate the fluid actuated rams in synchronization with each other. This is seen as useful as the movement of the tines laterally with respect to the loading vehicle may be smoother and more uniform than if the two cylinders were independently operable. Furthermore, by having the two cylinders operating in synchronization, the pressures exerted on each of the cylinders will be reduced as they can work together to move the load on the tines.

In a further embodiment of the invention there is provided a forklift truck in which there are provided friction reducing members positioned intermediate the movable carriage and the fixed carriage. The friction reducing members may be any one of a brass pad, a nylon pad or roller bearings. These friction reducing members will facilitate movement of the movable carriage relative the fixed carriage and will reduce wear and tear to the components of the side shift mechanism thereby prolonging the active life of the side shift mechanism.

In another embodiment of the invention there is provided a forklift truck as claimed in any preceding claim in which there is provided an energy chain connected to a fluid line feed for each of the fluid actuated rams. This is seen as very useful as the energy chain will keep the hydraulic line feed for the cylinders from becoming tangled up. This will help the side shift mechanism to operate in the manner intended without requiring constant time consuming rearranging of the hydraulic line feeds by the operator.

In one embodiment of the invention there is provided a forklift truck as claimed in any preceding claim in which when the movable carriage is in a central position, one of the fluid actuated rams is in a fully extended configuration while the other of the fluid actuated rams is in a fully retracted configuration. In this way only one fluid actuated ram will need to be operated to move the movable carriage from one side to the other and precise adjustment of the position of the movable frame will be possible.

In a further embodiment of the invention there is provided a forklift truck in which when the movable carriage is in a central position, both of the fluid actuated rams are in a half extended configuration with the pistons at half stroke in the cylinders. In this way, both fluid actuated rams may be fed from the same fluid supply and can operate in synchronization with each other. Alternatively, the rams may be operated independently of each other yet neither will have to be at full stroke in order to keep the movable carriage in a central position. This will help avoid undue stresses being placed on either of the rams thereby providing a forklift with a side shift mechanism that is less prone to failure.

DETAILED DESCRIPTION OF THE INVENTION

The invention will now be more clearly understood from the following description of some embodiments thereof given by way of example only with reference to the accompanying drawings in which:—

Figure 11:
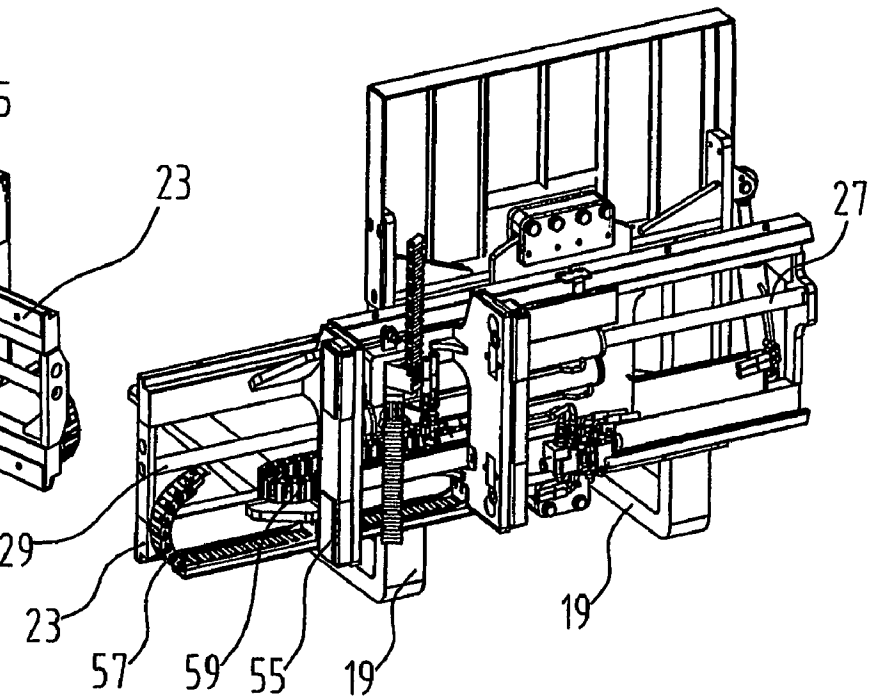
Figure 10:
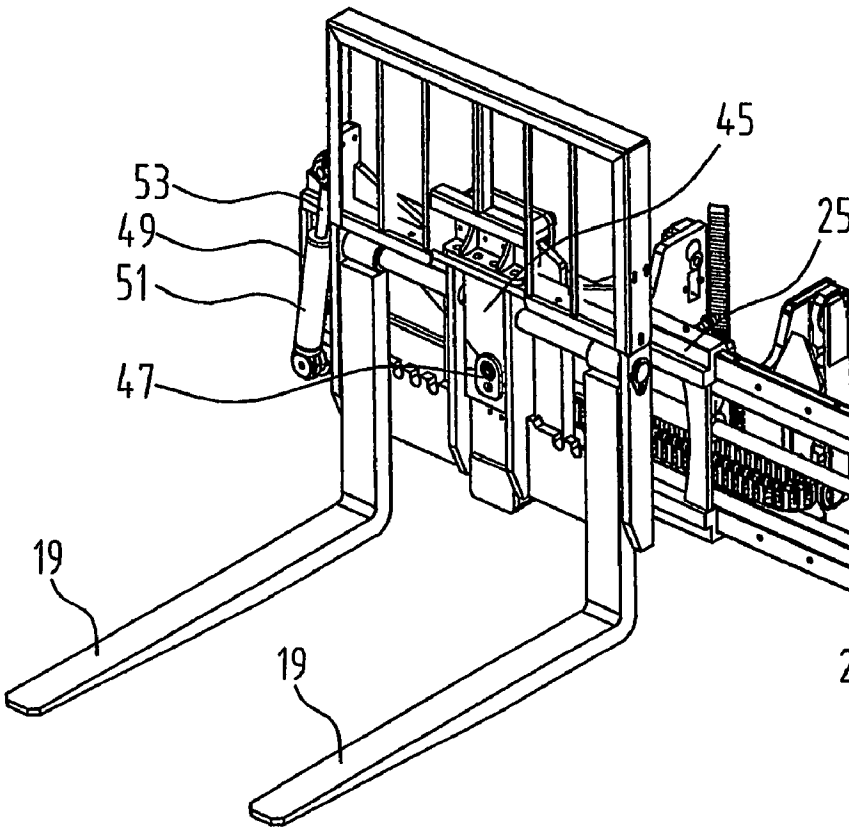

FIG. 10 is a front perspective view of the side shift mechanism for use with the forklift according to the invention with forks mounted thereon and the movable carriage in a full right shift position; and FIG. 11 is a rear perspective view of the side shift mechanism for use with the forklift according to the invention with forks mounted thereon and the movable carriage in a full right shift position.

Figure 1:
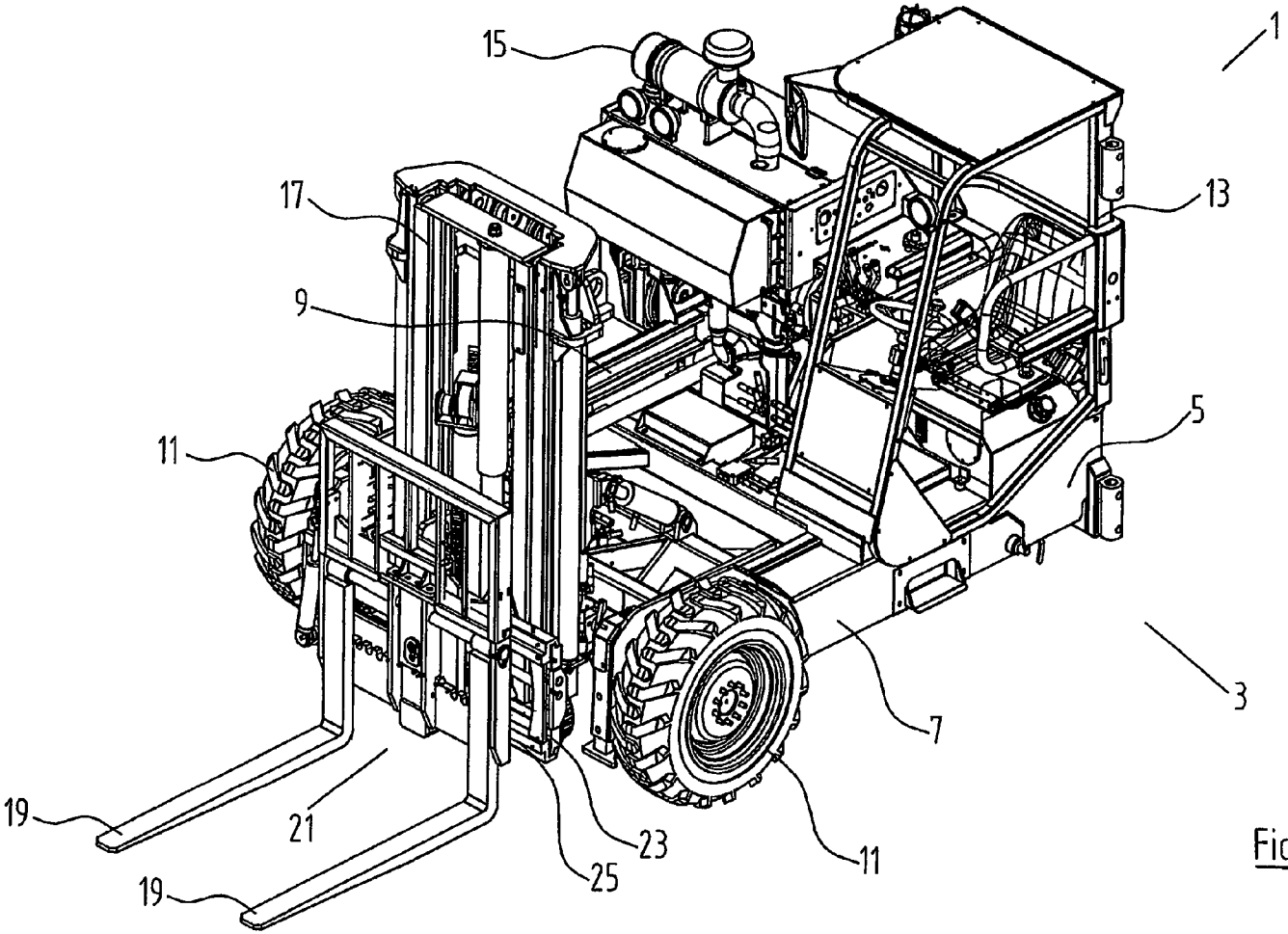
FIG. 1 is a front perspective view of a forklift truck according to the invention.
Figure 12:
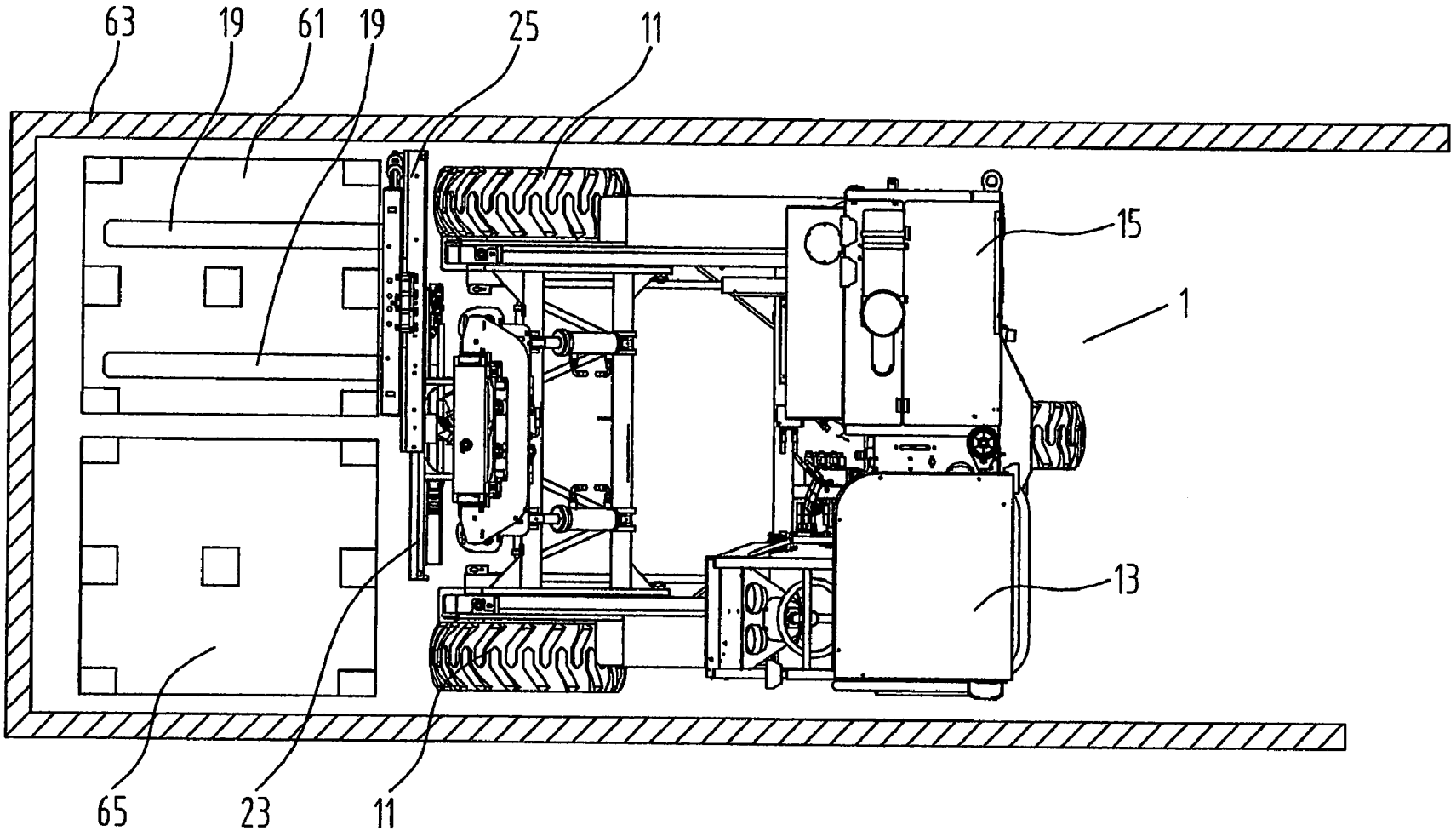

FIG. 12 is a plan view of the forklift truck shown in FIG. 1 shown loading a pallet into a container;

Referring to the drawings and initially to FIG. 1 thereof there is shown a forklift truck, indicated generally by the reference numeral 1, for mounting on the rear of a carrying vehicle, the forklift truck comprising a unshaped chassis 3 having a crossbar 5 and a pair of side bars 7, 9 connected to the ends of the crossbar 5 and projecting forwardly therefrom. A wheel 11 is located adjacent the front of each of the side bars and a steerable rear wheel (not shown) is positioned centrally on the crossbar. A driver's station 13 is positioned to one side of the chassis 3 and a motive power unit 15 is positioned on the other side of the chassis. A lifting member, provided here by way of vertical mast 17, is mounted on the chassis and carries a pair of forks 19. The forks 19 are connected to the mast by way of a side shift mechanism 21 comprising a fixed carriage 23 and a movable carriage 25 slidably mounted on the fixed carriage. There are provided means (not shown) to shift the movable carriage relative the fixed carriage from a central position to positions laterally extending therefrom on either side of the fixed carriage.

Figures 2, 3, 4:
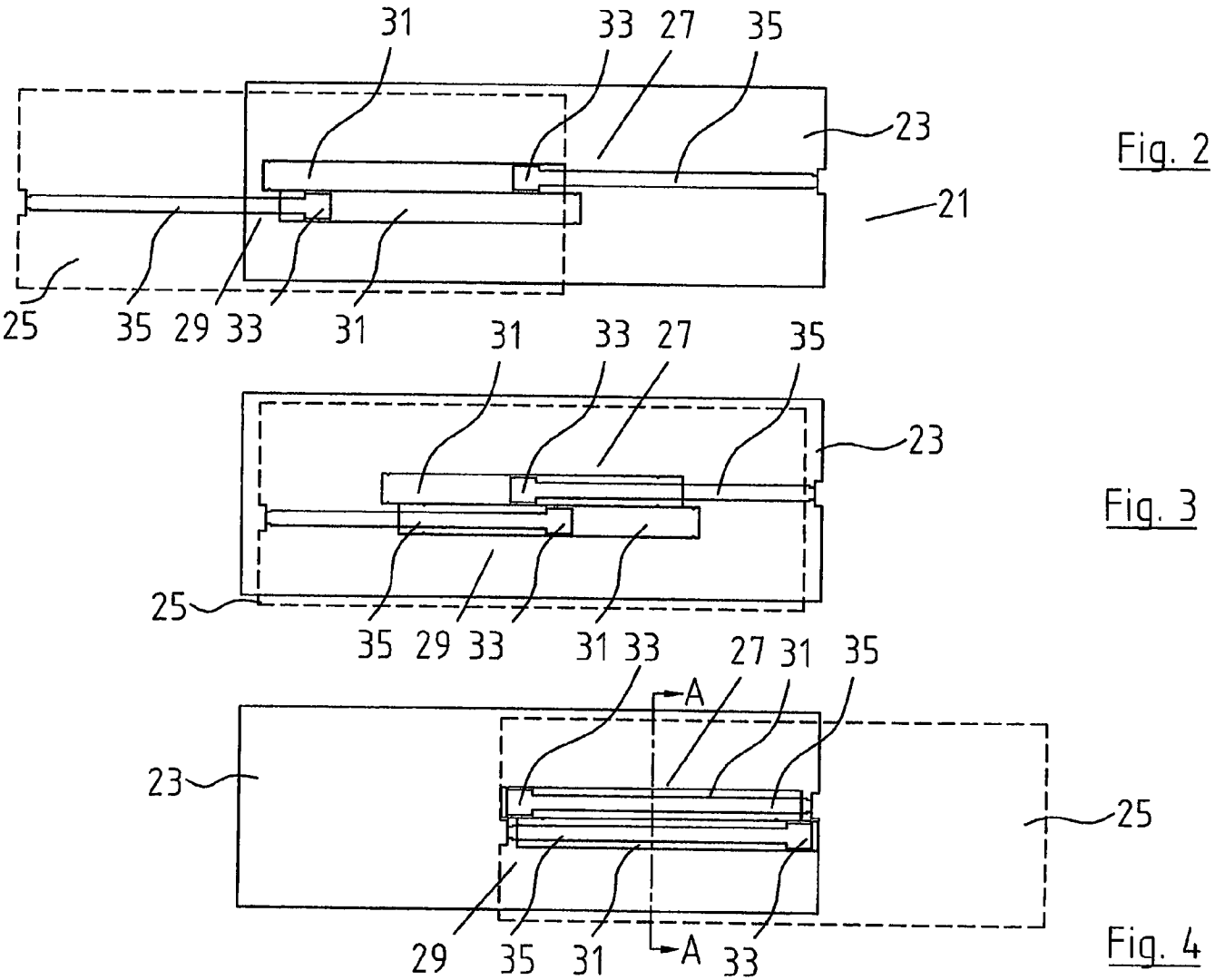
FIG. 2 is a simplified rear view of a side shift mechanism for use with the forklift according to the invention with the movable carriage in a full left shift position.
FIG. 3 is a simplified rear view of the side shift mechanism shown in FIG. 2 with the movable carriage in a centered position.
FIG. 4 is a simplified rear view of the side shift mechanism shown in FIG. 2 with the movable carriage in a full right shift position.

Referring to FIGS. 2 to 4 inclusive of the drawings there is shown a simplified view of a side shift mechanism for use with the forklift according to the invention where like parts have been given the same reference numeral as before. The side shift mechanism 21 comprises a fixed carriage 23 and a movable carriage 25 slidably mounted on the fixed carriage 23. The means to shift the movable carriage laterally relative the fixed carriage further comprises a pair of fluid actuated rams 27, 29, each of the fluid actuated rams having a cylinder 31, a piston 33 and an elongate piston rod 35 connected at one end to the piston 33. The cylinders 31 of the fluid actuated rams are connected together side by side, preferably by welding or other suitable means, and the free end of one of the piston rods 35 is connected to the fixed carriage 23 while the free end of the other piston rod 35 is connected to the movable carriage 25. Each of the fluid actuated rams is a double acting ram and fluid may be delivered to both ends of the ram cylinders through feed lines (not shown).

In use, an operator of the forklift should have the side shift mechanism 21 so that the movable carriage 25 in a centered position with respect to the fixed carriage 23, as shown in FIG. 3, with both of the fluid actuated rams 27, 29 in a half extended configuration. The operator of the vehicle (not shown) will drive the vehicle into a position adjacent a load (not shown) to be moved until the forks 19 are adjacent the load. If the forks 19 are not aligned with the load the operator of the vehicle actuates the pair of rams 27, 29 to shift the movable carriage 25 sideways and hence the forks 19 mounted thereon in a sideways direction until the forks are in alignment with the load. For example, if the operator desires to shift the movable carriage and hence the forks to the left, as shown in FIG. 2, he may do so by extending both of the fluid actuated rams 27, 29 either simultaneously or sequentially. When both fluid actuated rams 27, 29 are in a fully extended configuration the movable carriage 25 will be in a fully left shifted position. Alternatively, if the operator wishes to move the movable carriage 25 from a centered position relative the fixed carriage 23 to a position in which the movable carriage 25 and hence the forks are shifted laterally to the right, he may do so by contracting each of the hydraulic rams 27, 29 either simultaneously or sequentially. Once both hydraulic rams have been contracted fully, the movable carriage will be in a fully right shifted configuration.

Figure 5:
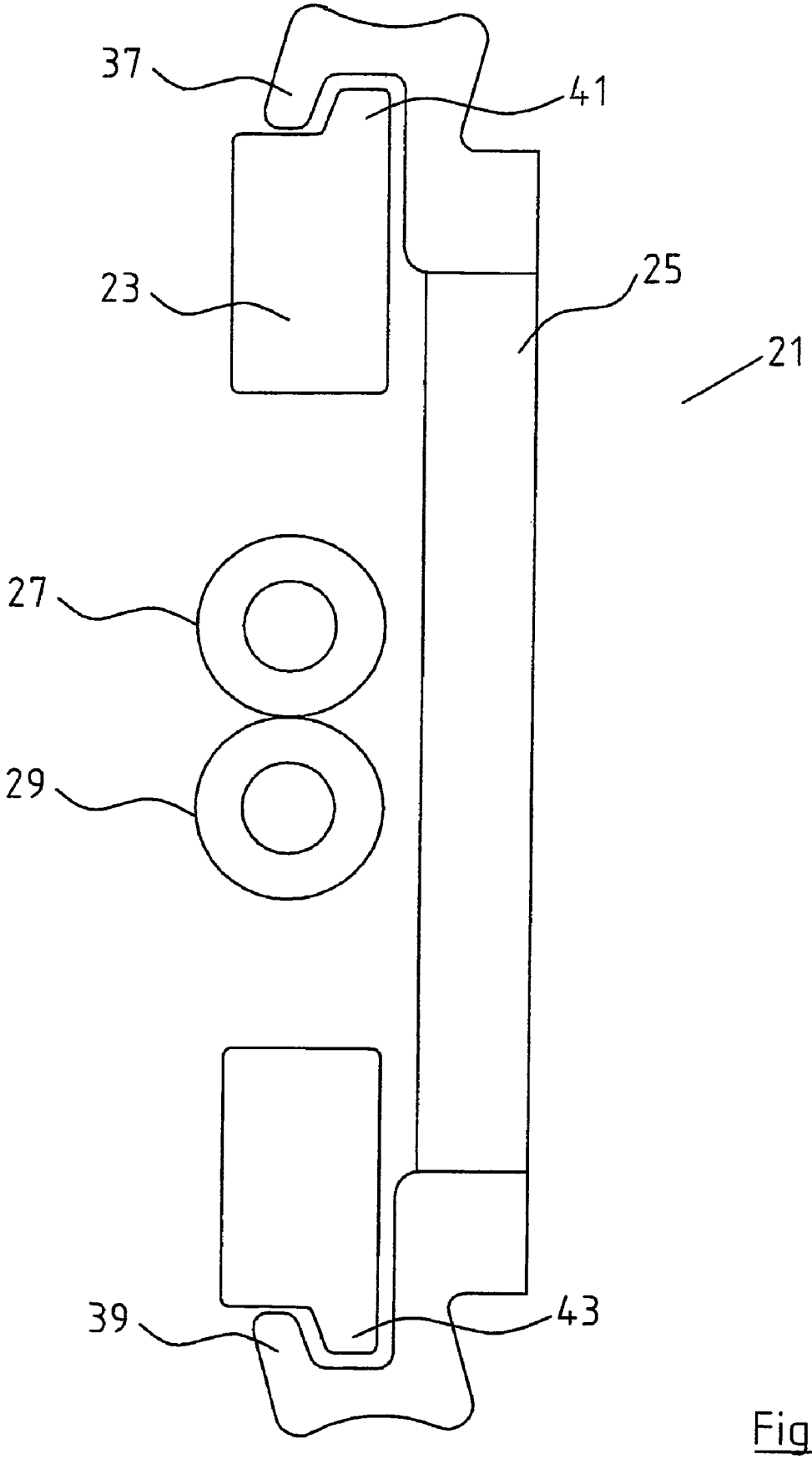
FIG. 5 is a simplified side view taken along the line A-A of the side shift mechanism shown in FIG. 4.

Referring to FIG. 5 of the drawings there is shown a side view taken from the right hand side of the side shift mechanism 21. The fluid actuated rams 27, 29 are connected together side by side by welding their respective cylinders 31 together. The movable carriage 25 is mounted on the fixed carriage 23 and retained thereon by way of inwardly depending lips 37, 39 formed on the movable carriage 25 which cooperate with corresponding outwardly depending lips 41, 43, respectively, formed on the fixed carriage 23. Friction reducing members (not shown) are placed intermediate the inwardly depending lips 37, 39 and the outwardly depending lips 41, 43, respectively to assist movement of the movable carriage 25 relative the fixed carriage 23.

Referring to FIGS. 6 to 11 inclusive there is shown a number of views of the side shift mechanism 21 ready for mounting on a lifting member of a forklift with the movable carriage 25 in a variety of different laterally shifted positions. The orientation of the fluid actuated rams 27, 29 has been reversed so that when the rams 27, 29 are both fully extended the movable carriage 25 will be shifted fully to the right with respect to the fixed carriage 23 and with both fluid actuated rams 27, 29 contracted the movable carriage 25 will be shifted fully to the left with respect to the fixed carriage 23. What is important is not the orientation of the fluid actuated rams with respect to the movable and fixed carriages but more the fact that when both of the rams are fully extended the movable carriage 25 is fully shifted in one direction and when both of the rams are contracted, the movable carriage 25 will be fully shifted in the other direction. A pair of forks 19 is mounted on a framework 45 which in turn is mounted on the movable carriage 25.

Figure 6:
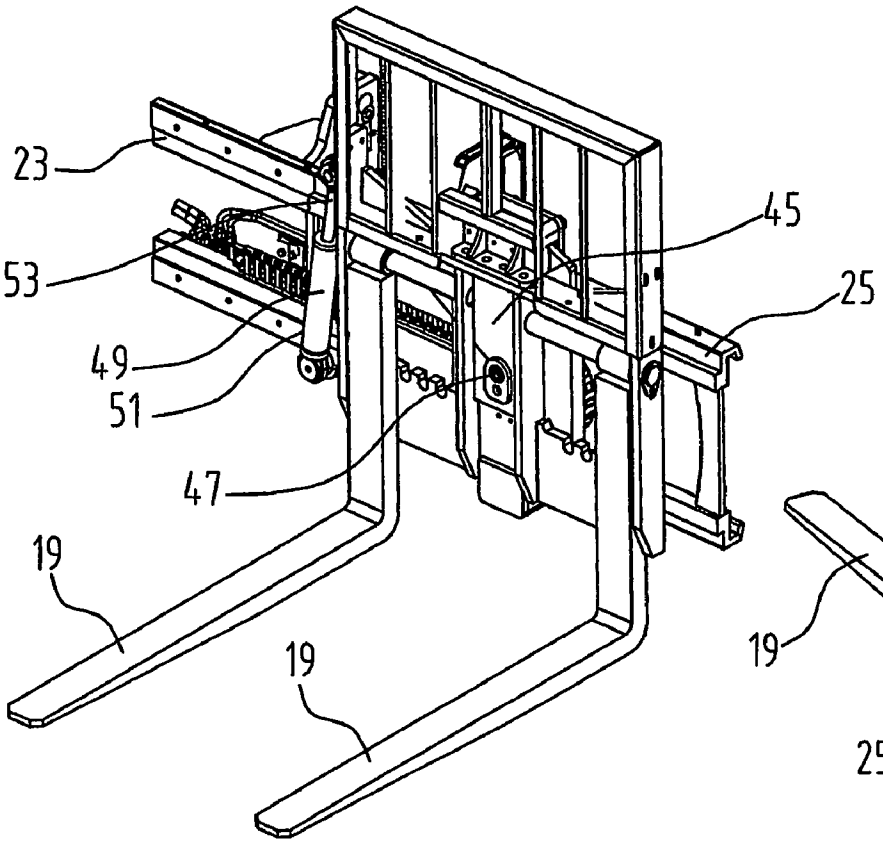
FIG. 6 is a front perspective view of the side shift mechanism for use with the forklift according to the invention with forks mounted thereon and the movable carriage in a full left shift position.
Figure 8:
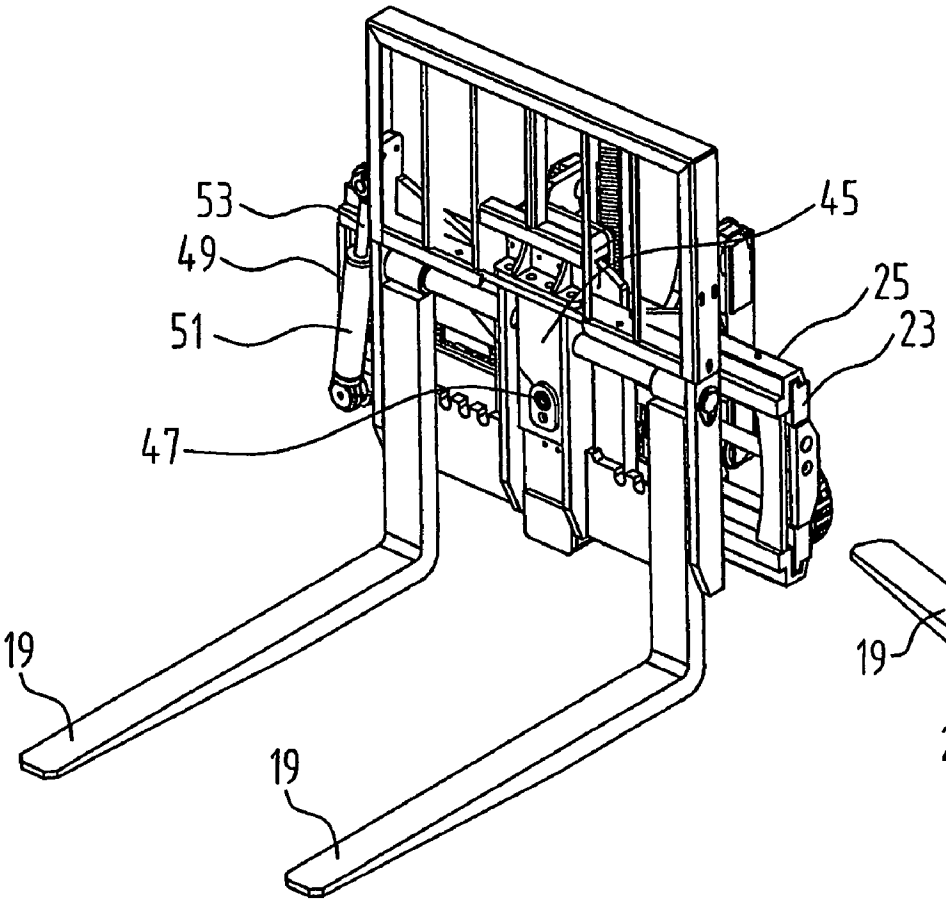
FIG. 8 is a front perspective view of the side shift mechanism for use with the forklift according to the invention with forks mounted thereon and the movable carriage in a centered position.

Referring specifically to FIGS. 6, 8 and 10, the framework 45 upon which the forks 19 are mounted is pivotally mounted on the movable carriage about a pivot pin 47. A rotating ram 49, having a cylinder 51, a piston (not shown) and a piston rod 53 is operable to cause the framework 45 to pivot about the pivot pin 47 on the movable carriage 25, parallel to a central longitudinal axis of the forklift, and raise one of the forks 19 relative the other fork whilst at the same time lowering the other fork. Rotation in either a clockwise or anti-clockwise direction may be achieved by expanding or contracting the rotating ram 49.

Figure 7:
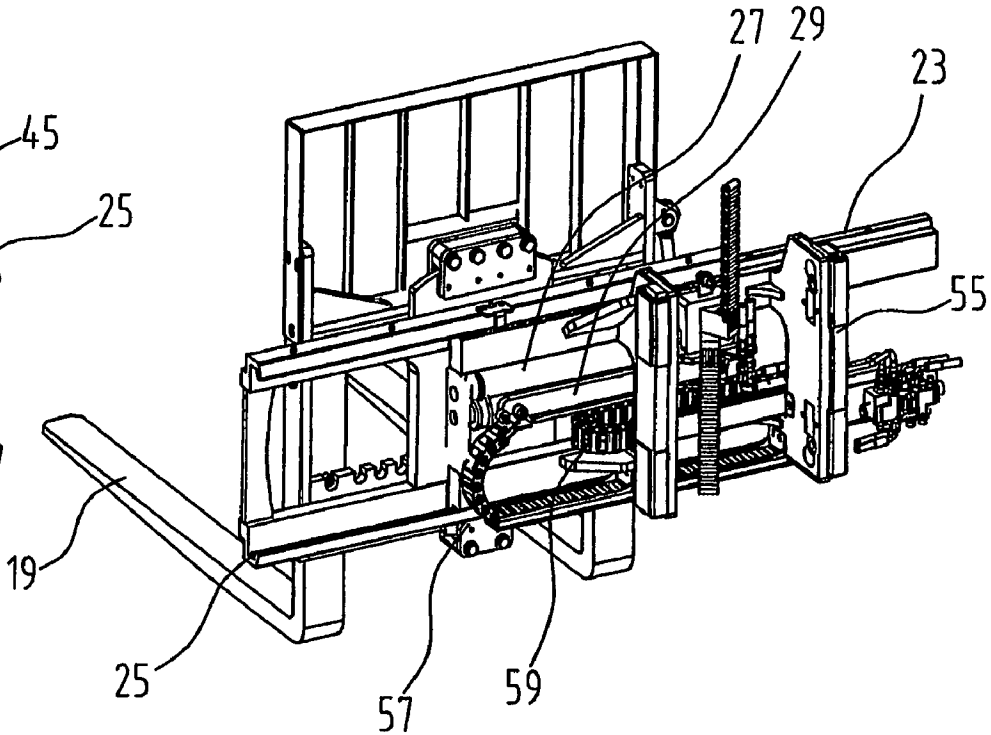
FIG. 7 is a rear perspective view of the side shift mechanism for use with the forklift according to the invention with forks mounted thereon and the movable carriage in a full left shift position.
Figure 9:
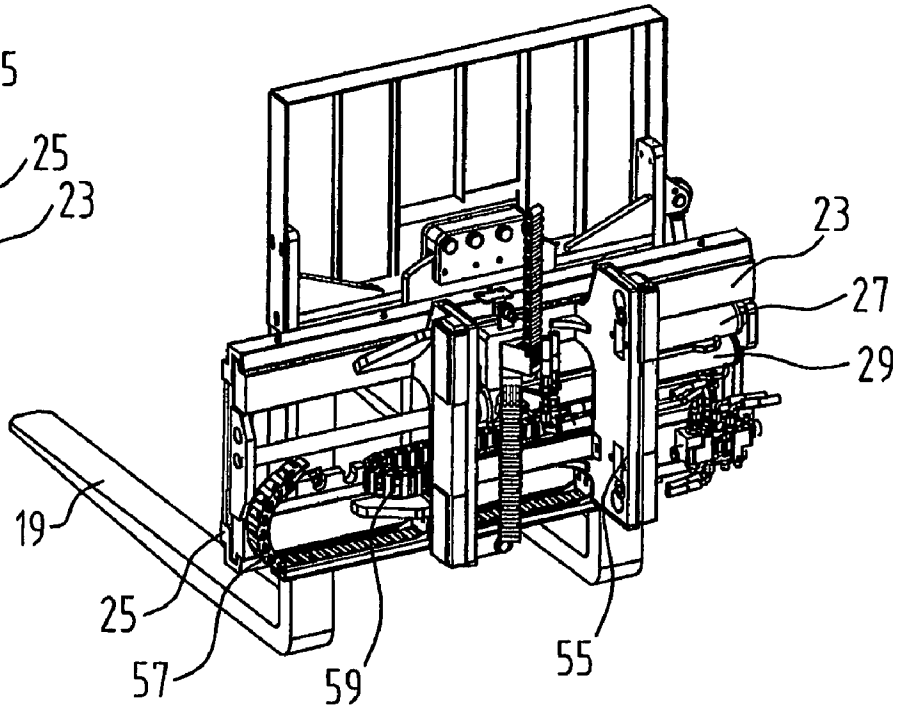
FIG. 9 is a rear perspective view of the side shift mechanism for use with the forklift according to the invention with forks mounted thereon and the movable carriage in a centered position.

Referring specifically to FIGS. 7, 9 and 11, there is shown a bracket 55 mounted on the fixed carriage 23. This bracket 55 can be connected directly onto the lifting member of the forklift such as a vertical mast or a telescopic boom in the known manner by one skilled in the art. In this way, the side shift mechanism 21 will not have to be mounted onto an existing lifting plate (not shown) mounted on the lifting member of the forklift which would reduce the lift capacity of the carrying vehicle. The hydraulic line feeds for each of the cylinders are encapsulated in so-called energy chains 57, 59 which will follow a known path as the movable carriage 25 moves from one side to the other about the fixed carriage 23. This will prevent the hydraulic line feeds from becoming twisted and tangled up in other machinery and will prevent kinks forming in the hydraulic line feeds.

Referring to FIG. 12 of the drawings there is shown a plan view of the forklift truck shown loading a pallet 61 into a container 63. It can be seen that in order to pack the container as compactly as possible the forklift must be able to shift the forks 19 sideways in order to move the pallet 61 as close to the side wall of the container 63 as possible. In order to load the pallet into the container the operator of the vehicle will maneuver the forklift truck 1 into the container as far as possible until the pallet is almost abutting against the pallet 65 already stored in the container. Once there, the operator of the forklift will operate the fluid actuated rams 27, 29 and shift the entire movable carriage with pallet 61 thereon to the right until the pallet 61 will pass pallet 65. The operator of the forklift then moves the forklift forward once more until the pallet is in the desired position adjacent the side wall of the container and the pallet 65 and then releases the pallet from the forks 19. Of course, it will be understood that the operator of the vehicle could shift the pallet to one side or the other as desired prior to entering the container. The order of operation is not important.

In the embodiments described the fluid actuated rams 27, 29 are preferably hydraulic rams having a cylinder 31 and cooperating piston 33 and piston rod 35. Alternatively the rams could in fact be pneumatic rams. The rams are preferably double acting rams but could be single acting rams. It must be understood however that if single acting rams are used in place of the double acting rams, a return biasing means urging each of the single acting rams to a fully contracted configuration must be provided in order for the side shift mechanism to work. Without such a biasing means the side shift mechanism would not work as the fluid actuated rams could not be returned to a fully contracted position once the fluid pressure had been released from the ram. A strong spring located internal the cylinder urging the piston to a contracted configuration could be used or alternatively biasing means located external the cylinder acting on the movable frame could be used. What is important is that a strong biasing force is applied to the side shift mechanism that will be sufficient to shift the movable carriage in the direction so that the fluid actuated rams are fully contracted once fluid pressure is released from the fluid actuated rams.

It will be understood by the person skilled in the art that the operation and configuration of the rams described is only one such configuration and the connectivity and operation could be reversed. In other words the ram 27 could be connected to the movable carriage and the ram 29 could be connected to the fixed carriage and contraction of the ram 27 could be used to move the movable carriage from a right shifted position to a centered position.

Furthermore, the order in which the fluid actuated rams 27, 29 are operated in the embodiment described is only one possible way in which the rams may be operated. The rams 27, 29 are preferably operated in synchronization with each other as they can therefore be provided from a common fluid supply with a standard T junction (not shown) to split the flow of fluid evenly between the two fluid actuated rams, this will reduce the complexity and amount of feed line cable that must be provided. If the rams are operated in synchronization, the rams will be able to shift the movable carriage to one side or the other quickly in unison. Simultaneous operation of the pair of cylinders 27, 29 will significantly reduce the amount of time it takes to move the carriage to or from an off centre position. Alternatively, the rams may be operated independently of each other which will allow much smaller increments and hence more accurate positioning of the forks 19 to be achieved. Either ram could be fully extended or contracted without changing the position of the other ram.

In the embodiments described it was stated that friction reducing members could be located intermediate the inwardly depending lips 37, 39 of the movable carriage 25 and the outwardly depending lips 41, 43 of the fixed carriage 23. These friction reducing members could be provided by way of nylon pads which are hard wearing and inexpensive to use. Alternatively, the friction reducing members could be provided by way of a brass strip or roller bearings.

In this specification the terms "comprise, comprises, comprised and comprising" and the terms "include, includes, included and including" are deemed totally interchangeable and should be afforded the widest possible interpretation.

This invention is in no way limited to the embodiments hereinbefore described but may be varied in both construction and detail within the scope of the claims.

The invention claimed is:

1. A forklift truck for mounting on the rear of a carrying vehicle, the forklift truck comprising a u-shaped chassis having a crossbar and pair of side bars mounted at the ends of the crossbar and projecting forwardly therefrom in the longitudinal direction of the truck, a wheel located adjacent the front of each of the sidebars, a steerable rear wheel located centrally on the crossbar, a driver's station positioned to one side of the chassis and a motive power unit positioned on the opposite side of the chassis, the chassis mounting a lifting member carrying forks, the lifting member being connected to the forks by way of a side shift mechanism comprising a fixed carriage and a movable carriage slidably mounted on the fixed carriage, the forks being mounted on the movable carriage, and means to shift the movable carriage relative the fixed carriage from a central position to positions laterally extending therefrom on either side of the fixed carriage, the means to shift the movable carriage laterally relative the fixed carriage further comprises a pair of fluid actuated rams each having a cylinder, a piston and an elongate piston rod connected at one end to the piston, the cylinders of the pair of fluid actuated rams being connected together side by side, the free end of one of the piston rods being connected to the fixed carriage and the free end of the other piston rod being connected to the movable carriage.

2. A forklift truck as claimed in claim 1 in which the forks are mounted on a framework, the framework being mounted for pivotal movement about a horizontal axis parallel to the horizontal longitudinal axis of the forklift truck, the forks being movable under the operation of a rotating ram.

3. A forklift truck as claimed in claim 1 in which each fluid actuated ram is a single acting ram and there is further provided a return biasing means urging each of the single acting rams to a fully contracted configuration.

4. A forklift truck as claimed in claim 1 in which each fluid actuated ram is a double acting ram.

5. A forklift truck as claimed in claim 1 in which each fluid actuated ram is a hydraulic ram.

6. A forklift truck as claimed in claim 1 in which each fluid actuated ram is a pneumatic ram.

7. A forklift truck as claimed in claim 1 in which there is provided means to operate the fluid actuated rams in synchronization with each other.

8. A forklift truck as claimed in claim 1 in which there is provided means to operate the fluid actuated rams independently of each other.

9. A forklift truck as claimed in claim 1 in which there are provided friction reducing members positioned intermediate the movable carriage and the fixed carriage.

10. A forklift truck as claimed in claim 9 in which the friction reducing members are any one of a brass pad, a nylon pad or roller bearings.

11. A forklift truck as claimed in claim 1 in which there is provided an energy chain connected to a fluid line feed for each of the fluid actuated rams.

12. A forklift truck as claimed in claim 1 in which when the movable carriage is in a central position, one of the fluid actuated rams is in a fully extended configuration while the other of the fluid actuated rams is in a fully retracted configuration.

13. A forklift truck as claimed in claim 1 in which when the movable carriage is in a central position, both of the fluid actuated rams are in a half extended configuration with the pistons at half stroke in the cylinders.

14. A forklift truck for mounting on the rear of a carrying vehicle, the forklift truck comprising a u-shaped chassis having a crossbar and pair of side bars mounted at the ends of the crossbar and projecting forwardly therefrom in the longitudinal direction of the truck, a wheel located adjacent the front of each of the sidebars, a steerable rear wheel located centrally on the crossbar, a driver's station positioned to one side of the chassis and a motive power unit positioned on the opposite side of the chassis, the chassis mounting a lifting member carrying forks, the lifting member being connected to the forks by way of a side shift mechanism comprising a fixed carriage and a movable carriage slidably mounted on the fixed carriage, the forks being mounted on the movable carriage, and means to shift the movable carriage relative the fixed carriage from a central position to positions laterally extending therefrom on either side of the fixed carriage, the means to shift the movable carriage laterally relative the fixed carriage further comprises a pair of fluid actuated rams each having a cylinder, a piston and an elongate piston rod connected at one end to the piston, the cylinders of the pair of fluid actuated rams being connected together side by side, the free end of one of the piston rods being connected to the fixed carriage and the free end of the other piston rod being connected to the movable carriage, and in which the forks are mounted on a framework, the framework being mounted for pivotal movement about a horizontal axis parallel to the horizontal longitudinal axis of the forklift truck, the forks being movable under the operation of a rotating ram.

15. A forklift truck as claimed in claim 14 in which each fluid actuated ram is a single acting ram and there is further provided a return biasing means urging each of the single acting rams to a fully contracted configuration.

16. A forklift truck as claimed in claim 14 in which each fluid actuated ram is a double acting ram.

17. A forklift truck as claimed in claim 14 in which there is provided means to operate the fluid actuated rams in synchronization with each other.

18. A forklift truck as claimed in claim 14 in which there is provided means to operate the fluid actuated rams independently of each other.

19. A forklift truck as claimed in claim 14 in which when the movable carriage is in a central position, one of the fluid actuated rams is in a fully extended configuration while the other of the fluid actuated rams is in a fully retracted configuration.

20. A forklift truck as claimed in claim 14 in which when the movable carriage is in a central position, both of the fluid actuated rams are in a half extended configuration with the pistons at half stroke in the cylinders.

21. A forklift truck for mounting on the rear of a carrying vehicle, the forklift truck comprising a u-shaped chassis having a crossbar and pair of side bars mounted at the ends of the crossbar and projecting forwardly therefrom in the longitudinal direction of the truck, a wheel located adjacent the front of each of the sidebars, a steerable rear wheel located centrally on the crossbar, a driver's station positioned to one side of the chassis and a motive power unit positioned on the opposite side of the chassis, the chassis mounting a lifting member carrying forks, the lifting member being connected to the forks by way of a side shift mechanism comprising a fixed carriage and a movable carriage slidably mounted on the fixed carriage, the forks being mounted on the movable carriage, and means to shift the movable carriage relative the fixed carriage from a central position to positions laterally extending therefrom on either side of the fixed carriage, the means to shift the movable carriage laterally relative the fixed carriage further comprises a pair of fluid actuated rams each having a cylinder, a piston and an elongate piston rod connected at one end to the piston, the cylinders of the pair of fluid actuated rams being connected together side by side, the free end of one of the piston rods being connected to the fixed carriage and the free end of the other piston rod being connected to the movable carriage, and in which there is provided means to operate the fluid actuated rams in synchronization with each other.

22. A forklift truck as claimed in claim 21 in which when the movable carriage is in a central position, one of the fluid actuated rams is in a fully extended configuration while the other of the fluid actuated rams is in a fully retracted configuration.

23. A forklift truck as claimed in claim 21 in which when the movable carriage is in a central position, both of the fluid actuated rams are in a half extended configuration with the pistons at half stroke in the cylinders.

* * * * *